United States Patent [19]

Lee

[11] Patent Number: 4,858,250

[45] Date of Patent: Aug. 22, 1989

[54] DISPOSABLE SANITARY SPITTOON

[76] Inventor: Chin C. Lee, No. 10, Nan-I Lane, Changshow Rd., Feng Yuean City, Taiwan

[21] Appl. No.: 271,287

[22] Filed: Nov. 15, 1988

[51] Int. Cl.[4] ..... A61J 19/00

[52] U.S. Cl. ..... 4/258; 4/274; 4/283

[58] Field of Search ..... 4/258, 267, 271, 274, 4/283, 285

[56] References Cited

U.S. PATENT DOCUMENTS

| | | | |
|---|---|---|---|
| 907,875 | 12/1908 | Pritchard | 4/274 |
| 4,159,549 | 7/1979 | Layton, Jr. | 4/285 |
| 4,768,238 | 9/1988 | Kleinberg et al. | 4/258 |

FOREIGN PATENT DOCUMENTS

| | | | |
|---|---|---|---|
| 19216 | 2/1905 | Australia | 4/259 |

*Primary Examiner*—Henry J. Recla
*Assistant Examiner*—Robert M. Fetsuga
*Attorney, Agent, or Firm*—Bacon & Thomas

[57] ABSTRACT

A disposable sanitary spittoon including a spittoon container of plastic or paper, a cover associated with the container and a molded absorption block of high molecular hydrophilic polymer within the container. The block is formed with a through hole for receiving a tube, a recess at the bottom thereof, and a concave surface. The tube is made of plastic or paper and is provided with cilia on its interior surface. The lengths of the cilia increase with respect to the downward direction of the tube.

1 Claim, 3 Drawing Sheets

DISPOSABLE SANITARY SPITTOON

BACKGROUND OF THE INVENTION

This invention relates to a sanitary spittoon, especially a disposable sanitary spittoon of low cost.

Conventional spittoons have some disadvantages. For example, they are quite expensive and thus not considered to be disposable. Therefore, they often need to be cleaned. In addition, if it is knocked over inadvertently, the liquid content therein is apt to flow out. These are really undesirable.

SUMMARY OF THE INVENTION

It is an object of the invention to provide a low cost disposable spittoon which does not need to be cleaned.

Another object of the invention is to provide a sanitary spittoon wherein none of the contents is apt to spill out even when the spittoon is knocked over.

In accordance with the invention, there is provided a spittoon container of plastic or paper which may be lined with foil. A cover is associated with the container by hinge means. Within the container is disposed a molded absorption block of high molecular hydrophilic polymer which is formed with a through hole for receiving a tube, a recess at the bottom thereof, and a concave surface. The phlegm spit on the surface oozes down the surface and into the tube which is made of plastic or paper and provided with cilia on the interior surface thereof. The lengths of the cilia gradually increase in the downward direction of the tube.

An embodiment of the invention will now be described by way of example only with reference to the accompanying drawings.

DETAILED DESCRIPTION OF THE PREFERRED EMBODIMENT

Figure 1:
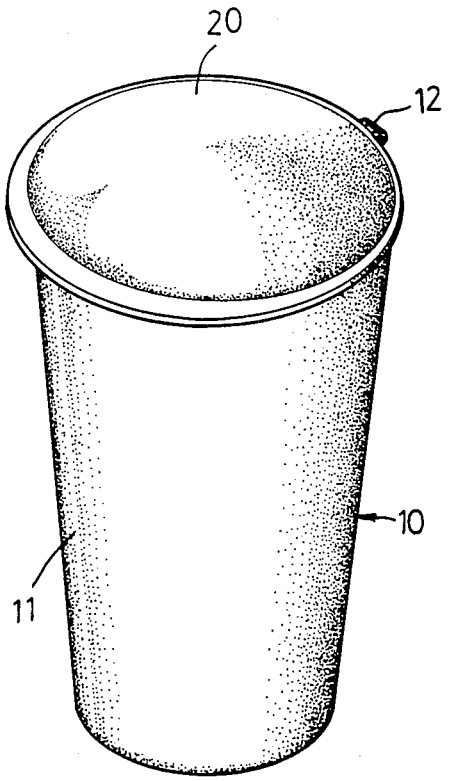
FIG. 1 is a perspective view of a disposable sanitary spittoon in accordance with the present of the invention.

Referring to the drawings and initially to FIG. 1, it can be seen that a sanitary spittoon is designated by reference numeral 10. The sanitary spittoon 10 includes a spittoon container 11 and a cover 20 of plastic or paper. The cover 20 is associated with the container 11 in this exemplary case by hinge means 12.

Figure 2:
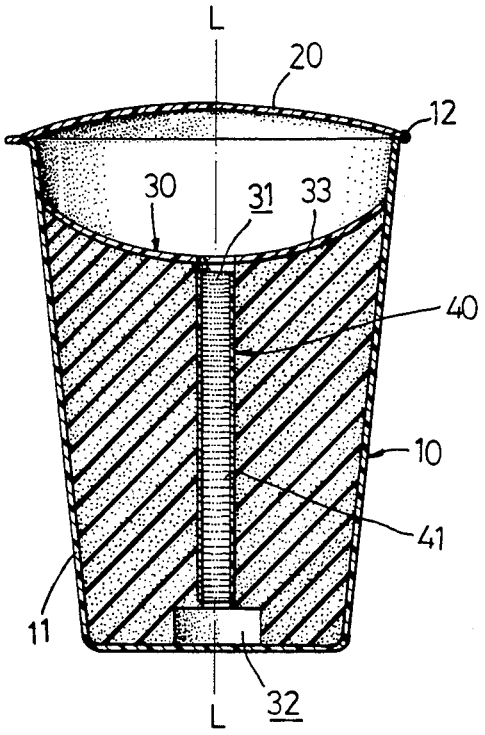
FIG. 2 is a sectional elevation view of the sanitary spittoon of FIG. 1.

Referring next to FIG. 2, the spittoon container 11 is symmetrical with respect to the central line L—L and which may be lined with foil (not shown). Within the container 11 is a molded block 30, which is also symmetrical with respect to the line L—L, of high molecular hydrophilic polymer for absorbing the low-viscosity content of the waste matter; e.g. phlegm, disposed thereon. The block 30 is formed with a through hole 31 for receiving a tube 40 through which waste matter can pass, a recess at the bottom thereof which defines a chamber 32 within the container 11 for receiving the waste matter, and a concave surface 33.

Figure 3:
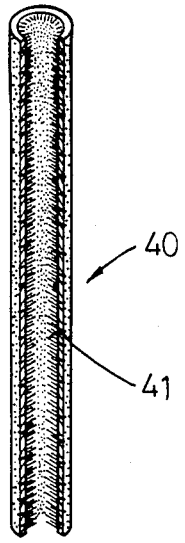
FIG. 3 is a perspective view of a tube of the sanitary spittoon, with a portion thereof broken away to illustrate the inner structure of the tube.

The phlegm oozes down the concave surface 33 and into the tube 40 which is made of plastic or paper and is provided with cilia 41 on the interior surface thereof. The lengths of the cilia 41 gradually increase in the downward direction of the tube 40 (see FIG. 3.) Therefore, the phlegm can ooze down the tube 40 but cannot ooze out of the container 11 when the latter is inadvertently prostrated. Optionally, the block 30 may be added with some fragrant sterilizing agent.

It is apparent that various alterations and modifications may be made to the above-described embodiment of the invention without departing from the spirit and scope of the invention. The scope of the invention is restricted by the appended claim.

I claim:

1. A disposable sanitary spittoon comprising:

a spittoon container having an open upper end:

a cover removably mounted on said container to close said open upper end;

a molded block disposed within said container, said molded block having a concave upper surface and being made of high molecular hydrophilic polymer for absorbing liquid, said block being formed with at least one through hole for receiving at least one respective tube therein and at least ione recess at a bottom thereof communicating with said at least one respective tube; said tube being made of plastic or paper and being provided with cilia on an interior surface thereof, respective lengths of said cilia gradually increasing with respect to the downward direction of said tube.

* * * * *